US009679505B2

(12) United States Patent
Liang et al.

(10) Patent No.: US 9,679,505 B2
(45) Date of Patent: Jun. 13, 2017

(54) METHOD AND DEVICE FOR CALIBRATING A PROJECTOR

(71) Applicants: Lenovo (Beijing) Limited, Beijing (CN); Beijing Lenovo Software Ltd., Beijing (CN)

(72) Inventors: Qiliang Liang, Beijing (CN); Jing Zhang, Beijing (CN); Xingming Yu, Beijing (CN)

(73) Assignees: BEIJING LENOVO SOFTWARE LTD., Beijing (CN); LENOVO (BEIJING) LIMITED, Beijing (CN)

( * ) Notice: Subject to any disclaimer, the term of this patent is extended or adjusted under 35 U.S.C. 154(b) by 273 days.

(21) Appl. No.: 14/457,554

(22) Filed: Aug. 12, 2014

(65) Prior Publication Data

US 2015/0235581 A1 Aug. 20, 2015

(51) Int. Cl.
*G09G 3/00* (2006.01)

(52) U.S. Cl.
CPC ..... *G09G 3/002* (2013.01); *G09G 2340/045* (2013.01); *G09G 2340/0464* (2013.01); *G09G 2356/00* (2013.01)

(58) Field of Classification Search
CPC ..... G09G 3/002; G09G 2340/045; G09G 2356/00
See application file for complete search history.

(56) References Cited

U.S. PATENT DOCUMENTS

2009/0091510 A1* 4/2009 Gatley ..... G06F 3/002 345/1.1
2013/0207942 A1* 8/2013 Imai ..... G09G 5/003 345/204
2014/0125554 A1* 5/2014 Pan ..... G06T 3/40 345/2.2
2015/0035864 A1* 2/2015 Murphy ..... G06F 17/30241 345/634

* cited by examiner

*Primary Examiner* — Jacinta M Crawford
*Assistant Examiner* — Jonathan M Cofino
(74) *Attorney, Agent, or Firm* — Schwegman Lundberg & Woessner, P.A.

(57) ABSTRACT

A method comprises: detecting a first parameter of the projection area with respect to the projection unit; obtaining a second parameter of the projection unit; determining a third parameter and a fourth parameter of the projection area and first attribute information of the one or more display objects, according to the first parameter and the second parameter; judging whether the first attribute information of the one or more display objects satisfies a predetermined first presentation requirement, so as to generate a first judgment result; adjusting the first attribute information of the one or more display objects to second attribute information, if the first judgment result indicates that the first attribute information of the one or more display objects does not satisfy the first presentation requirement. The present invention improve display effects of certain display objects by changing the display parameters of the display objects, in order to achieve an effect of clearly displaying respective display objects.

6 Claims, 4 Drawing Sheets

METHOD AND DEVICE FOR CALIBRATING A PROJECTOR

CROSS-REFERENCE TO RELATED APPLICATION(S)

This application claims priority to Chinese Application No. 201410054003.3, filed on Feb. 17, 2014, which is incorporated herein by reference in their entirety.

TECHNICAL FIELD

The present disclosure relates to information processing technologies, and particularly, to an information processing method and an electronic device.

BACKGROUND

When an electronic device is being used, there may be a case where a display object in an image projected by a projection unit cannot achieve a desired display effect. Although a projection proportion of the projection unit may be adjusted, such an adjustment is performed by scaling the image as a whole, and cannot, in many cases, improve the display effect of a particular display object. In the related art, there is no effective solution on how to improve the display effect of the projection rapidly and conveniently.

SUMMARY

In order to solve the above technical problem, embodiments of the present invention provide an electronic device and an information processing method, which allow the display effect of a projection display object of the electronic device to be automatically adjusted according to a projection area, and thus improve user's watching experience.

Technical solutions of the present invention may be implemented as follows.

According to one aspect of the present invention, there is provided an information processing method applied in an electronic device. The electronic device comprises a projection unit capable of projecting first data of the electronic device to be displayed onto a projection area in which one or more display objects of the first data to be displayed are presented. The method comprises steps of: detecting a first parameter of the projection area with respect to the projection unit; obtaining a second parameter of the projection unit; determining a third parameter and a fourth parameter of the projection area and first attribute information of the one or more display objects, according to the first parameter and the second parameter; judging whether the first attribute information of the one or more display objects satisfies a predetermined first presentation requirement, so as to generate a first judgment result; and, adjusting the first attribute information of the one or more display objects to second attribute information, if the first judgment result indicates that the first attribute information of the one or more display objects does not satisfy the first presentation requirement.

According to another aspect of the present invention, there is provided an electronic device. The electronic device comprises a projection unit capable of projecting first data of the electronic device to be displayed onto a projection area in which one or more display objects of the first data to be displayed are presented. The electronic device further comprises: a detection unit, a first obtaining unit, a determination unit, a first judgment unit, a first generation unit, and a first adjustment unit, wherein the detection unit is configured for detecting a first parameter of the projection area with respect to the projection unit; the first obtaining unit is configured for obtaining a second parameter of the projection unit; the determination unit is configured for determining a third parameter and a fourth parameter of the projection area and first attribute information of the one or more display objects, according to the first parameter and the second parameter; the first judgment unit is configured for judging whether the first attribute information of the one or more display objects satisfies a predetermined first presentation requirement; the first generation unit is configured for generating a first judgment result; and, the first adjustment unit is configured for adjusting the first attribute information of the one or more display objects to second attribute information, if the first judgment result indicates that the first attribute information of the one or more display objects does not satisfy the first presentation requirement.

According to the technical solutions provided by the present invention, in case the projection unit of the electronic device is used for projection display and some of display objects do not have desired display effects, the display effects of certain display objects may be improved by changing display parameters of said certain display objects, so as to achieve the effect of clearly displaying respective display objects.

DETAILED DESCRIPTION

Hereinafter, the present invention will be described in detail in connection with particular embodiments with reference to the drawings.

Figure 1:
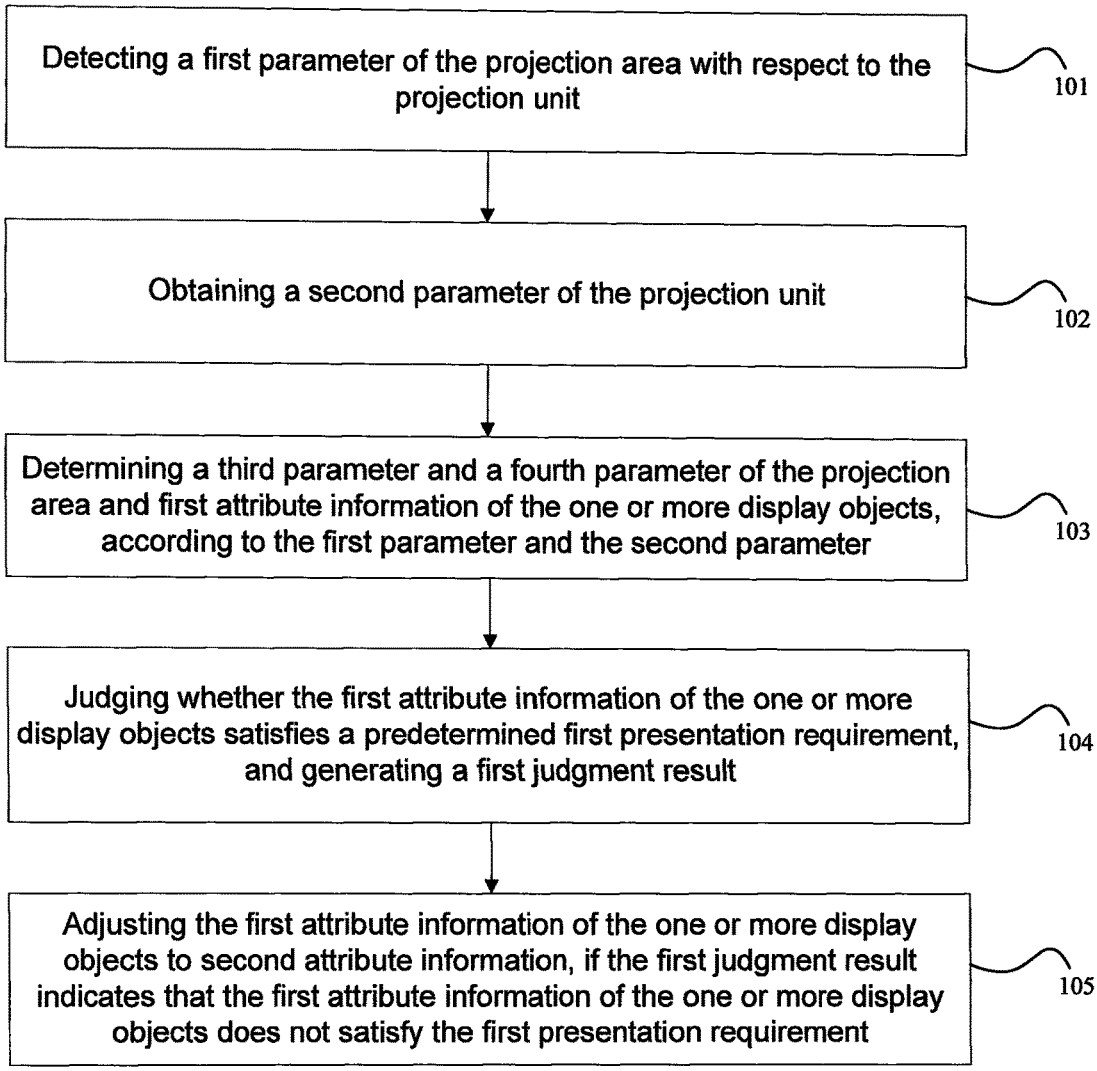
FIG. 1 is a schematic flowchart of an information processing method according to a first embodiment of the present invention.

FIG. 1 is a schematic flowchart of an information processing method according to a first embodiment of the present invention. The information processing method can be applied in an electronic device. The electronic device comprises a projection unit capable of projecting first data of the electronic device to be displayed onto a projection area in which one or more display objects of the first data to be displayed are presented. In this example, the electronic device may be a mobile phone, a game player, a PAD, a personal digital assistant, a portable computer and etc.

In step 101 a first parameter of the projection area with respect to the projection unit is detected.

The electronic device detects a distance of the electronic device from the projection area via a distance measurement unit, the projected distance being the first parameter. In particular, the distance measurement unit may be a depth camera, which may determine a distance of the camera from an object by photographing the object. There are one or more display objects in the projection area. The distance to some display object in the projection area may be measured by the depth camera of the electronic device, so as to determine the distance between the electronic device and the projection area. Of course, the display object in the projection area which has generality may be taken as the target object on which the distance measurement is performed. In this regard, examples may comprise setting a display object dedicated for the distance measurement; or setting a specific projection speckle, e.g. taking blank display areas of the projection area as the specific projection speckle wherein these blank display areas have display characteristics different from those of other display objects; or taking a particular point in the projection area as the target object of the distance measurement, e.g. taking a central point in the projection display area as the target object of the distance measurement. Thus, the distance between the electronic device and the projection area may be determined by measuring the distance to the specific speckle or the particular point in the projection area, rather than by identifying a particular display object in the projection area and then determining the distance between the electronic device and the projection area via the identified display object.

In step 102, a second parameter of the projection unit is obtained.

A projection angle of the projection unit and an original size of a projection screen may be obtained. Information about the projection angle and the size of the projection screen may be configured in the electronic device in advance. The electronic device may also obtain the projection angle of the projection unit by means of measurement etc. Here, the projection angle includes a projection angle in a vertical direction, and a projection angle in a horizontal direction. The original size of the projection screen may be the size of the display screen of the electronic device. In this example, the projection angle of the projection unit and the original size of the projection screen may be used as the second parameter.

In step 103, a third parameter and a fourth parameter of the projection area and first attribute information of the one or more display objects is determined, according to the first parameter and the second parameter.

According to the determined projection distance, the original size of the projection screen and the projection angle as mentioned above, the parameters such as a length and a width of the projection area may be determined. The size of the projection area may be determined by the determination of the length and the width of the projection area. A current projection density may be determined according to the size of the current projection area, so as to determine the projection density of the current display object in the projection area, wherein the projection density of the current display object in the projection area is taken as the first attribute information of the display object. It may be judged based on the projection density whether the display object is adapted to be viewed by the user of the electronic device.

In step 104, it is judged whether the first attribute information of the one or more display objects satisfies a predetermined first presentation requirement, so as to generate a first judgment result.

It may be determined for all of the display objects in the projection area whether the first attribute information of each display object satisfies the predetermined first presentation requirement. In particular, the display effect of each display object in the projection area may be determined according to the projection density of the display object. If it is determined that the projection density of some display object(s) does not satisfy the predetermined first presentation requirement, the projection density of the display object is required to be adjusted so as to achieve the effect of clearly displaying each of the display objects.

In step 105, the first attribute information of the one or more display objects to second attribute information is adjusted, if the first judgment result indicates that the first attribute information of the one or more display objects does not satisfy the first presentation requirement.

When it is determined that the first attribute information of the one or more display objects do not satisfy the first presentation requirement, particularly, if the projection density of one display object in the projection area does not satisfy the presentation requirement, adjustment on the projection density of the projection area is started, so as to achieve the aim of improving the projection density of the display object which does not satisfy the presentation requirement. Alternatively, when it is determined that the number of display objects in the projection area whose projection densities do not satisfy the presentation requirement is greater than a predetermined threshold, adjustment on the projection density of the projection area is started, so as to achieve the aim of improving the projection densities of the display objects which do not satisfy the presentation requirement. In particular, the adjustment on the projection density of the display objects which do not satisfy the presentation requirement may be fulfilled generally by adjusting the presentation effect of the whole projection area, so as to improve the display effect of the display objects. Of course, it is also possible to directly adjust, as required, the projection density of the display objects which do not satisfy the presentation requirement, e.g. directly improve the projection densities of the display objects which do not satisfy the presentation requirement.

The display objects in the projection area may be better presented to the user of the electronic device by adjusting the projection density of the display objects, so as to achieve the aim of better presenting the display objects.

As an implementation, a (e.g. rectangular) projection area may be adjusted to a square area according to the determined lengths of two sides, which are perpendicular to each other, of the (rectangular) projection area, wherein the longer side is taken as a reference. Additionally, a threshold range of the projection density may be set so that the projection density of the adjusted projection area falls within the threshold range of the projection density. For example, there may be a simple linear correspondence between the projection density and the projection size; and other function relationships may also be possible. In order to prevent an interface from being abnormally displayed, it should set the threshold range for the projection density, such as [80, 480]. As such, the display effect of a particular display object in the projection area may also be adjusted by adjusting the projection density of the whole projection area. In the embodiment of the present invention, the display unit is a display, a display screen, and etc. of the electronic device itself; the second display data to be displayed are data to be displayed in the electronic device such as pictures, video, text etc; like the first data to be displayed, the second data to be displayed may also be projected, or may be displayed by the display unit. It should be noted that the first data to be displayed and the second data to be displayed may be displayed in the display unit and the projection area at the same time. Of course, it is also possible that the data displayed in the display unit is totally different from the display data projected in the projection area.

In the above embodiment, the electronic device may further comprise a display unit, which can display and output the second data to be displayed. The first data to be displayed and the second data to be displayed are identical or not identical.

In the embodiment of the present invention, the display unit is a display, a display screen etc. of the electronic device itself; the second display data to be displayed are data to be displayed in the electronic device such as pictures, video, text etc; like the first data to be displayed, the second data to be displayed may also be projected, or may be displayed by the display unit. It should be noted that the first data to be displayed and the second data to be displayed may be displayed in the display unit and the projection area at the same time. Of course, the data displayed in the display unit may be totally different from the display data projected in the projection area.

As an implementation, the electronic device of the embodiment in the present invention may further comprise a detection unit configured with a corresponding detection area. The detection unit can detect a relevant object in the detection area. The detection area is a part of or all of a projection area. The detection unit may determine the distance between the electronic device and the projection area by detecting e.g. an image or a speckle to be detected in the detection area, and the detected distance may be used as the first parameter. In particular, the first parameter may be determined by means of laser or ultrasound etc., or by means of the depth camera etc.

Figure 2:
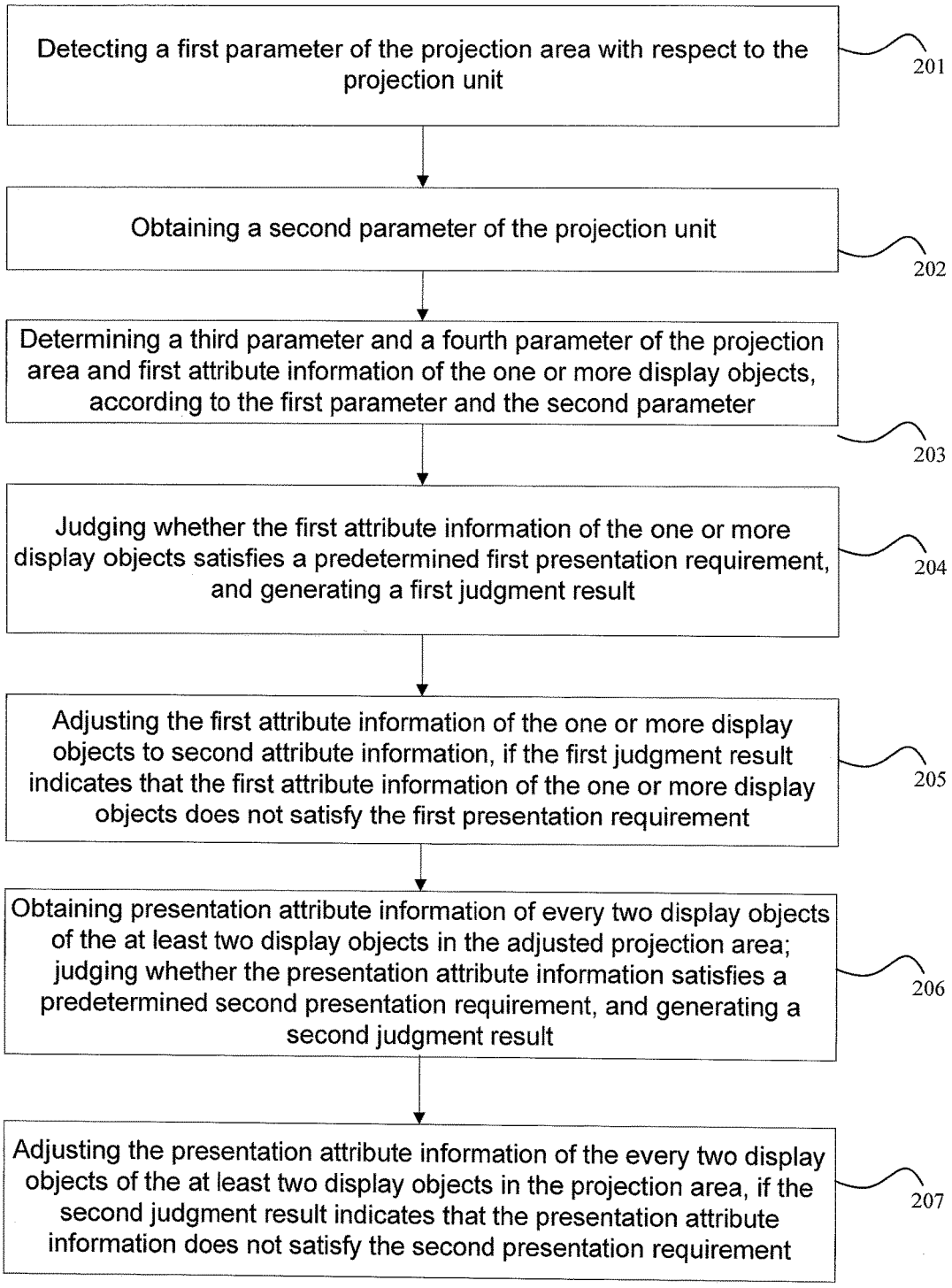
FIG. 2 is a schematic flowchart of an information processing method according to a second embodiment of the present invention.

FIG. 2 is a schematic flowchart of an information processing method according to a second embodiment of the present invention. The information processing method can be applied in an electronic device. The electronic device comprises a projection unit capable of projecting first data of the electronic device to be displayed onto a projection area in which one or more display objects of the first data to be displayed are presented. In this embodiment, the electronic device may be a mobile phone, a game player, a PAD, a personal digital assistant, a portable computer and etc.

In step 201, a first parameter of the projection area with respect to the projection unit is detected.

The electronic device detects a distance of the electronic device from the projection area via a distance measurement unit, the projected distance being the first parameter. In particular, the distance measurement unit may be a depth camera, which may determine a distance of the camera from an object by photographing the object. There are one or more display objects in the projection area. The distance to some display object in the projection area may be measured by the depth camera of the electronic device, so as to determine the distance between the electronic device and the projection area. Of course, the display object in the projection area which has generality may be taken as the target object on which the distance measurement is performed. In this regard, examples may comprise setting a display object dedicated for the distance measurement; or setting a specific projection speckle, e.g. taking blank display areas of the projection area as the specific projection speckle wherein these blank display areas have display characteristics different from those of other display objects; or taking a particular point in the projection area as the target object of the distance measurement, e.g. taking a central point in the projection display area as the target object of the distance measurement. Thus, the distance between the electronic device and the projection area may be determined by measuring the distance to the specific speckle or the particular point in the projection area, rather than by identifying a particular display object in the projection area and then determining the distance between the electronic device and the projection area via the identified display object.

In step 202, a second parameter of the projection unit is obtained.

A projection angle of the projection unit and an original size of a projection screen may be obtained. Information about the projection angle and the size of the projection screen may be configured in the electronic device in advance. The electronic device may also obtain the projection angle of the projection unit by means of measurement etc. Here, the projection angle includes a projection angle in a vertical direction, and a projection angle in a horizontal direction. The original size of the projection screen may be the size of the display screen of the electronic device. In this example, the projection angle of the projection unit and the original size of the projection screen may be used as the second parameter.

In step 203, a third parameter and a fourth parameter of the projection area and first attribute information of the one or more display objects is determined, according to the first parameter and the second parameter.

According to the determined projection distance, the original size of the projection screen and the projection angle as mentioned above, the parameters such as a length and a width of the projection area may be determined. The size of the projection area may be determined by the determination of the length and the width of the projection area. A current projection density may be determined according to the size of the current projection area, so as to determine the projection density of the current display object in the projection area, wherein the projection density of the current display object in the projection area is taken as the first attribute information of the display object. It may be judged based on the projection density whether the display object is adapted to be viewed by the user of the electronic device.

In step 204, it is judged whether the first attribute information of the one or more display objects satisfies a predetermined first presentation requirement, so as to generate a first judgment result.

It may be determined for all of the display objects in the projection area whether the first attribute information of each display object satisfies the predetermined first presentation requirement. In particular, the display effect of each display object in the projection area may be determined according to the projection density of the display object. If it is determined that the projection density of some display object(s) does not satisfy the predetermined first presentation requirement, the projection density of the display object is required to be adjusted so as to achieve the effect of clearly displaying each of the display objects.

In step 205, the first attribute information of the one or more display objects to second attribute information is adjusted, if the first judgment result indicates that the first attribute information of the one or more display objects does not satisfy the first presentation requirement.

When it is determined that the first attribute information of the one or more display objects do not satisfy the first presentation requirement, particularly, if the projection density of one display object in the projection area does not satisfy the presentation requirement, adjustment on the projection density of the projection area is started, so as to achieve the aim of improving the projection density of the display object which does not satisfy the presentation requirement. Alternatively, when it is determined that the number of display objects in the projection area whose projection densities do not satisfy the presentation requirement is greater than a predetermined threshold, adjustment on the projection density of the projection area is started, so as to achieve the aim of improving the projection densities of the display objects which do not satisfy the presentation requirement. In particular, the adjustment on the projection density of the display objects which do not satisfy the presentation requirement may be fulfilled generally by adjusting the presentation effect of the whole projection area, so as to improve the display effect of the display objects. Of course, it is also possible to directly adjust, as required, the projection density of the display objects which do not satisfy the presentation requirement, e.g. directly improve the projection densities of the display objects which do not satisfy the presentation requirement.

The display objects in the projection area may be better presented to the user of the electronic device by adjusting the projection density of the display objects, so as to achieve the aim of better presenting the display objects.

As an implementation, a (e.g. rectangular) projection area may be adjusted to a square area according to the determined lengths of two sides, which are perpendicular to each other, of the (rectangular) projection area, wherein the longer side is taken as a reference. Additionally, a threshold range of the projection density may be set so that the projection density of the adjusted projection area falls within the threshold range of the projection density. For example, there may be a simple linear correspondence between the projection density and the projection size; and other function relationships may also be possible. In order to prevent an interface from being abnormally displayed, it should set the threshold range for the projection density, such as [80, 480]. As such, the display effect of a particular display object in the projection area may also be adjusted by adjusting the projection density of the whole projection area.

In step 206, presentation attribute information of every two display objects of the at least two display objects in the adjusted projection area is obtained, and it is judged whether the presentation attribute information satisfies a predetermined second presentation requirement, so as to generate a second judgment result.

Additionally, when the size of the projection area is determined, the sizes, on the projection area, of respective display objects within the projection screen may be determined. In particular, when the projection area is determined, a zoom-in proportion of the projected display objects, and thus the display sizes of respective display objects on the projection area, may be determined according to the original size of the projection screen and the determined projection area It is judged whether the display sizes of the current two or more display objects in the projection area are too large or too small. The display objects being displayed too large or too small will affect the viewing experience of the user. Therefore, when the display size of any display object is beyond a predetermined threshold range, it may be judged that the presentation attribute information of the display object needs to be adjusted.

In step 207, the presentation attribute information of the every two display objects of the at least two display objects in the projection area is adjusted, if the second judgment result indicates that the presentation attribute information does not satisfy the second presentation requirement.

When it is determined that the display size of a display object is beyond the predetermined threshold range, the display size of the display object which is beyond the predetermined threshold range may be adjusted. The adjustment of the display size of the display object should not cause any display object to overlap with another display object.

In the above example, the electronic device may further comprise a display unit, which can display and output the second data to be displayed. The first data to be displayed and the second data to be displayed are identical or not identical.

In the embodiment of the present invention, the display unit is a display, a display screen etc. of the electronic device itself; the second display data to be displayed are data to be displayed in the electronic device such as pictures, video, text etc; like the first data to be displayed, the second data to be displayed may also be projected, or may be displayed by the display unit. It should be noted that the first data to be displayed and the second data to be displayed may be displayed in the display unit and the projection area at the same time. Of course, the data displayed in the display unit may be totally different from the display data projected in the projection area.

As an implementation, the electronic device of the embodiment in the present invention may further comprise a detection unit configured with a corresponding detection area. The detection unit can detect a relevant object in the detection area. The detection area is a part of or all of a projection area. The detection unit may determine the distance between the electronic device and the projection area by detecting e.g. an image or a speckle to be detected in the detection area, and the detected distance may be used as the first parameter. In particular, the first parameter may be determined by means of laser or ultrasound etc., or by means of the depth camera etc.

Figure 3:
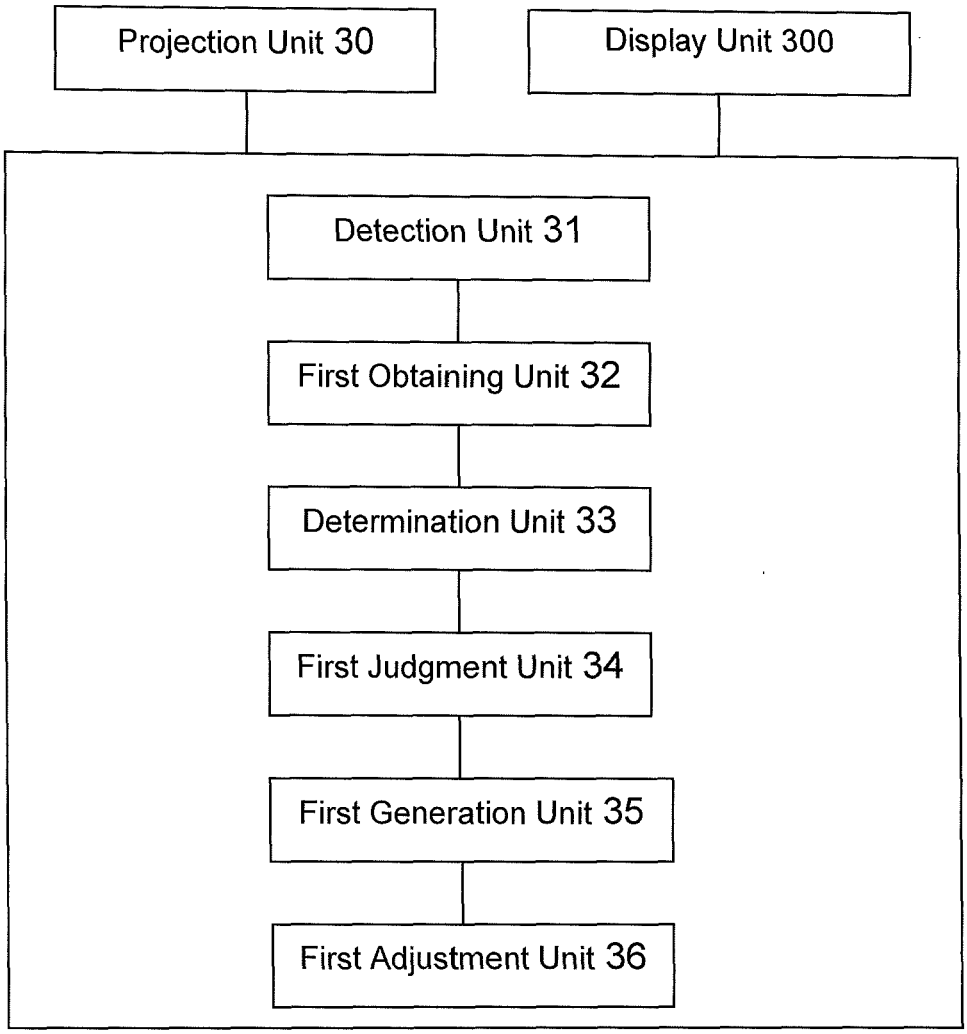
FIG. 3 is a schematic structure diagram of an electronic device according to a third embodiment of the present invention.

FIG. 3 is a schematic structure diagram of an electronic device according to a third embodiment of the present invention. As shown in FIG. 3, the electronic device according to the embodiment of the present invention comprises a projection unit 30 capable of projecting first data of the electronic device to be displayed onto a projection area in which one or more display objects of the first data to be displayed are presented. The electronic device further comprises: a detection unit 31, a first obtaining unit 32, a determination unit 33, a first judgment unit 34, a first generation unit 35, and a first adjustment unit 36.

The detection unit 31 is configured for detecting a first parameter of the projection area with respect to the projection unit 30.

The first obtaining unit 32 is configured for obtaining a second parameter of the projection unit. In particular, the first obtaining unit 32 is configured for obtaining a projection angle of the projection unit and an original size of a projection screen. Information about the projection angle and the size of the projection screen may be configured in the electronic device in advance.

The determination unit 33 is configured for determining a third parameter and a fourth parameter of the projection area and first attribute information of the one or more display objects, according to the first parameter and the second parameter. According to the determined projection distance, the original size of the projection screen and the projection angle as mentioned above, the parameters such as a length and a width of the projection area may be determined. The size of the projection area may be determined by the determination of the length and the width of the projection area. A current projection density may be determined according to the size of the current projection area, so as to determine the projection density of the current display object in the projection area, wherein the projection density of the current display object in the projection area is taken as the first attribute information of the display object. It may be judged based on the projection density whether the display object is adapted to be viewed by the user of the electronic device. Of course, a display size of the display object or a projection proportion of the display object in the projection area may also be taken as the first attribute information. Whether the display object is adapted to be viewed by the user of the electronic device can be judged by determining the projection size and the projection proportion.

The first judgment unit 34 is configured for judging whether the first attribute information of the one or more display objects satisfies a predetermined first presentation requirement. It may be determined for all of the display objects in the projection area whether the first attribute information of each display object satisfies the predetermined first presentation requirement. In particular, the display effect of each display object in the projection area may be determined according to the projection density of the display object. If it is determined that the projection density of some display object(s) does not satisfy the predetermined first presentation requirement, the projection density of the display object is required to be adjusted so as to achieve the effect of clearly displaying each of the display objects. Of course, determined whether each of the display objects may be clearly displayed may also be determined by determining the display size of the display object or the display proportion of the display object in the projection area.

The first generation unit 35 is configured for generating a first judgment result.

The first adjustment unit 36 is configured for adjusting the first attribute information of the one or more display objects to second attribute information, if the first judgment result indicates that the first attribute information of the one or more display objects does not satisfy the first presentation requirement. When it is determined that the first attribute information of the one or more display objects do not satisfy the first presentation requirement, particularly, if the projection density of one display object in the projection area does not satisfy the presentation requirement, adjustment on the projection density of the projection area is started, so as to achieve the aim of improving the projection density of the display object which does not satisfy the presentation requirement. Alternatively, when it is determined that the number of display objects in the projection area whose projection densities do not satisfy the presentation requirement is greater than a predetermined threshold, adjustment on the projection density of the projection area is started, so as to achieve the aim of improving the projection densities of the display objects which do not satisfy the presentation requirement.

The electronic device as illustrated in FIG. 3 may be a mobile phone, a game player, a PAD, a personal digital assistant, a portable computer etc.

The electronic device as illustrated in FIG. 3 may further comprise a display unit 300, which can display and output the second data to be displayed. The first data to be displayed and the second data to be displayed are identical or not identical.

In the embodiment of the present invention, the display unit 300 is a display, a display screen etc. of the electronic device itself; the second display data to be displayed are data to be displayed in the electronic device such as pictures, video, text etc; like the first data to be displayed, the second data to be displayed may also be projected by the projection unit 30, or may be displayed by the display unit 300. It should be noted that the first data to be displayed and the second data to be displayed may be displayed in the display unit 300 and the projection area at the same time. Of course, the data displayed in the display unit 300 may be totally different from the display data projected in the projection area.

As an implementation, the detection unit 31 is further configured with a corresponding detection area. The detection unit 31 can detect a relevant object in the detection area. The detection area is a part of or all of a projection area. The detection unit 31 may determine the distance between the electronic device and the projection area by detecting e.g. an image or a speckle to be detected in the detection area, and the detected distance may be used as the first parameter. In particular, the detection unit 31 may determine the first parameter by means of laser or ultrasound etc., or the detection unit 31 may be a depth camera for photographing the relevant object in the detection area so as to determine the first parameter.

It should be understood by the skilled in the art that functions of respective processing units in the electronic device according to the embodiment of the present invention may be apparent with reference to related descriptions on the information processing method as previously described. The respective processing units in the electronic device according to the embodiment of the present invention may be implemented by analog circuits which implement the functions of the embodiments of the present invention, or may be implemented by a smart device running software performing the functions of the embodiments of the present invention.

Figure 4:
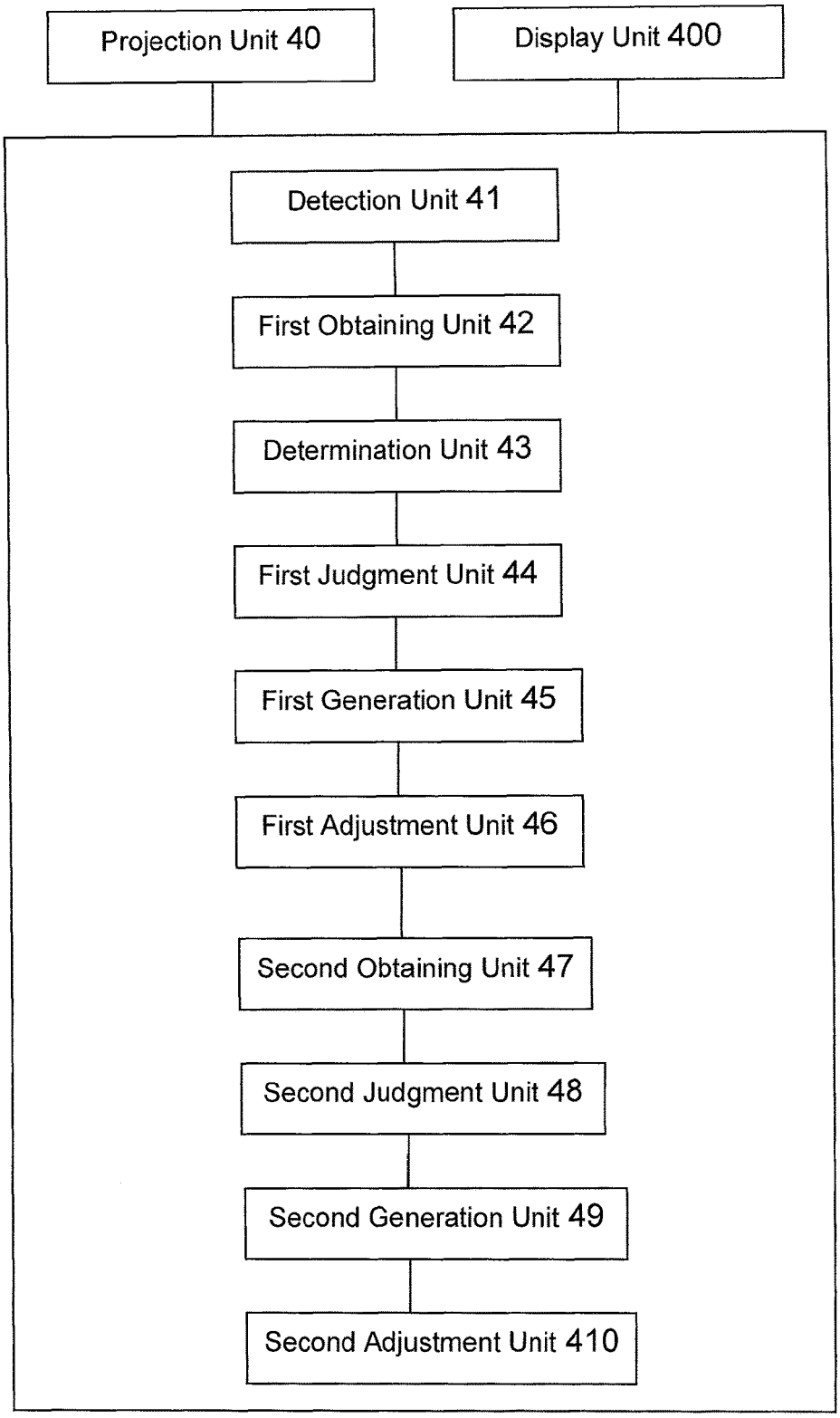
FIG. 4 is a schematic structure diagram of an electronic device according to a fourth embodiment of the present invention.

FIG. 4 is a schematic structure diagram of an electronic device according to a fourth embodiment of the present invention. As shown in FIG. 4, the electronic device according to the embodiment of the present invention comprises a projection unit 40 capable of projecting first data of the electronic device to be displayed onto a projection area in which one or more display objects of the first data to be displayed are presented. The electronic device further comprises: a detection unit 41, a first obtaining unit 42, a determination unit 43, a first judgment unit 44, a first generation unit 45, a first adjustment unit 46, a second obtaining unit 47, a second judgment unit 48, a second generation unit 49 and a second adjustment unit 410.

The detection unit 41 is configured for detecting a first parameter of the projection area with respect to the projection unit 40. The detection unit 41 corresponds to a detection area, and can detect a first parameter of the projection area with respect to the projection unit 40; wherein the detection area is partly or fully overlapped with the projection area. The detection unit 41 may detect a distance of the electronic device from the projection area, the projected distance being the first parameter.

The first obtaining unit 42 is configured for obtaining a second parameter of the projection unit. In particular, the first obtaining unit 42 is configured for obtaining a projection angle of the projection unit and an original size of a projection screen. Information about the projection angle and the size of the projection screen may be configured in the electronic device in advance.

The determination unit 43 is configured for determining a third parameter and a fourth parameter of the projection area and first attribute information of the one or more display objects, according to the first parameter and the second parameter. According to the determined projection distance, the original size of the projection screen and the projection angle as mentioned above, the parameters such as a length and a width of the projection area may be determined. The size of the projection area may be determined by the determination of the length and the width of the projection area. A current projection density may be determined according to the size of the current projection area, so as to determine the projection density of the current display object in the projection area wherein the projection density of the current display object in the projection area is taken as the first attribute information of the display object. It may be judged based on the projection density whether the display object is adapted to be viewed by the user of the electronic device. Of course, a display size of the display object or a projection proportion of the display object in the projection area may also be taken as the first attribute information. Whether the display object is adapted to be viewed by the user of the electronic device can be judged by determining the projection size and the projection proportion.

The first judgment unit 44 is configured for judging whether the first attribute information of the one or more display objects satisfies a predetermined first presentation requirement. It may be determined for all of the display objects in the projection area whether the first attribute information of each display object satisfies the predetermined first presentation requirement. In particular, the display effect of each display object in the projection area may be determined according to the projection density of the display object. If it is determined that the projection density of some display object(s) does not satisfy the predetermined first presentation requirement, the projection density of the display object is required to be adjusted so as to achieve the effect of clearly displaying each of the display objects. Of course, whether each of the display objects may be clearly displayed may also be determined by determining the display size of the display object or the display proportion of the display object in the projection area.

The first generation unit 45 is configured for generating a first judgment result.

The first adjustment unit 46 is configured for adjusting the first attribute information of the one or more display objects to second attribute information, if the first judgment result indicates that the first attribute information of the one or more display objects does not satisfy the first presentation requirement. When it is determined that the first attribute information of the one or more display objects do not satisfy the first presentation requirement, particularly, if the projection density of one display object in the projection area does not satisfy the presentation requirement, adjustment on the projection density of the projection area is started, so as to achieve the aim of improving the projection density of the display object which does not satisfy the presentation requirement. Alternatively, when it is determined that the number of display objects in the projection area whose projection densities do not satisfy the presentation requirement is greater than a predetermined threshold, adjustment on the projection density of the projection area is started, so as to achieve the aim of improving the projection densities of the display objects which do not satisfy the presentation requirement.

The one or more display objects presented in the projection area include at least two display objects. The second obtaining unit 47 is configured for obtaining presentation attribute information of every two display objects of the at least two display objects in the projection area, after the first attribute information of the one or more display objects is adjusted by the first adjustment unit to second attribute information.

The second judging unit 48 is configured for judging whether the presentation attribute information satisfies a predetermined second presentation requirement;

the second generation unit 49 is configured for generating a second judgment result;

the second adjustment unit 410 is configured for adjusting the presentation attribute information of the every two display objects of the at least two display objects in the projection area, if the second judgment result indicates that the presentation attribute information does not satisfy the second presentation requirement.

In the embodiment of the present invention, when the first adjustment on the display object still cannot achieve a desired display effect, a second adjustment may be performed on the projection area. If the first adjustment is to adjust the projection density, the second adjustment may be to adjust the display size of the display object, which may adjust the display size of an individual display object, or alternatively adjust the display sizes of all display objects. By the second adjustment, the display objects in the projection area may be displayed on the projection area more clearly.

The electronic device as illustrated in FIG. 4 may be a mobile phone, a game player, a PAD, a personal digital assistant, a portable computer etc.

The electronic device as illustrated in FIG. 4 may further comprise a display unit 400, which can display and output the second data to be displayed. The first data to be displayed and the second data to be displayed may be identical or not identical.

In the embodiment of the present invention, the display unit 400 is a display, a display screen etc. of the electronic device itself; the second display data to be displayed are data to be displayed in the electronic device such as pictures, video, text etc; like the first data to be displayed, the second data to be displayed may also be projected by the projection unit 40, or may be displayed by the display unit 400. It should be noted that the first data to be displayed and the second data to be displayed may be displayed in the display unit 400 and the projection area at the same time. Of course, the data displayed in the display unit 400 may be totally different from the display data projected in the projection area.

As an implementation, the detection unit 41 is further configured with a corresponding detection area. The detection unit 41 can detect a relevant object in the detection area. The detection area is a part of or all of a projection area. The detection unit 41 may determine the distance between the electronic device and the projection area by detecting e.g. an image or a speckle to be detected in the detection area, and the detected distance may be used as the first parameter. In particular, the detection unit 41 may determine the first parameter by means of laser or ultrasound etc., or the detection unit 41 may be a depth camera for photographing the relevant object in the detection unit so as to determine the first parameter.

It should be understood by the skilled in the art that functions of respective processing units in the electronic device according to the embodiment of the present invention may be apparent with reference to related descriptions on the information processing method as previously described. The respective processing units in the electronic device according to the embodiment of the present invention may be implemented by analog circuits which implement the functions of the embodiments of the present invention, or may be implemented by a smart device running software performing the functions of the embodiments of the present invention.

It can be appreciated from the embodiments of the present application that the disclosed device and method can be implemented in alternative ways. The device embodiments as described above are illustrative only. For example, while the units have been divided in accordance with their logical functions, other divisions are possible in practice. For example, more than one unit or element can be combined or can be integrated into another system, or some features can be ignored or omitted. In addition, the coupling, direct coupling or communicative connection between various components as shown or discussed can be an indirect coupling or communicative connection via some interface, device or unit and can be electrical, mechanical or in another form.

The units described above as separated may or may not be physically separated. The components shown as units may or may not be physical units. They can be co-located or can be distributed over a number of network elements. Depending on actual requirements, some or all of the units can be selected to achieve the object of the present disclosure.

Further, all the functional units in various embodiments of the present disclosure can be integrated within one processing unit, or each of these units can be a separate unit, or two or more units can be integrated into one unit. Such integrated unit can be implemented in hardware, possibly in combination with software functional units.

It may be understood by the skilled in the art that all or parts of steps for implementing the above method embodiments may be implemented by hardware associated with program instructions. The above program may be stored in a computer readable storage medium, which when executed, may perform steps of the above method embodiments. The above storage medium may comprise various media which may store program codes, such as a movable storage device, a read-only memory, a random access memory, a magnetic disc or an optical disc.

Or, if the units of the present invention integrated as described above are implemented in a form of software functional modules and are sold or used as a separate product, they may also be stored in a computer readable storage medium. Based on such understanding, the technical solution of the embodiment in the present invention may substantially, or the part of the technical solution contributing to the prior art may be embodied in a form of a software product. The computer software product is stored in a storage medium including several instructions which may be used for causing one computer device (which may be a personal computer, a server, or a network device etc.) to perform all or parts of the methods of various embodiments in the present invention. The storage medium as described above may comprise various media which may store program codes, such as a movable storage device, a read-only memory, a random access memory, a magnetic disc or an optical disc.

As illustrated above, it will be appreciated that specific embodiments of the disclosure have been described herein for purposes of illustration, but that various modifications may be made without deviating from the disclosure. In addition, many of the elements of one embodiment may be combined with other embodiments in addition to or in lieu of the elements of the other embodiments. Accordingly, the technology is not limited except as by the appended claims.

We claim:

1. A data processing method applied in an electronic device, the method comprising:

detecting a first parameter of a projection area with respect to a projection unit;

obtaining a second parameter of the projection unit;

determining a third parameter and a fourth parameter of the projection area and first attribute information of one or more display objects, according to the first parameter and the second parameter;

judging whether the first attribute information of the one or more display objects satisfies a predetermined first presentation requirement, so as to generate a first judgment result; and adjusting the first attribute information of the one or more display objects to second attribute information, if the first judgment result indicates that the first attribute information of the one or more display objects does not satisfy the first presentation requirement, wherein the one or more display objects presented in the projection area comprise at least two display objects; and wherein after the first attribute information of the one or more display objects is adjusted to the second attribute information, the method further comprises:

obtaining presentation attribute information of every two display objects of the at least two display objects in the projection area;

judging whether the presentation attribute information satisfies a predetermined second presentation requirement, so as to generate a second judgment result; and adjusting the presentation attribute information of the every two display objects of the at least two display objects in the projection area, if the second judgment result indicates that the presentation attribute information does not satisfy the second presentation requirement.

2. The method according to claim 1, wherein the method further comprises:

displaying and outputting second data to be displayed; and the first data to be displayed are identical or are not identical with the second data to be displayed.

3. The method according to claim 1, wherein the method further comprises:

detecting, corresponding to a detection area, and detecting the first parameter of the detection area with respect to the projection unit;

wherein the detection area is partly or fully overlapped with the projection area.

4. An electronic device, comprising:

a projection unit;

a memory; and a processor coupled to the memory and configured to:

detect a first parameter of a projection area with respect to the projection unit;

obtain a second parameter of the projection unit;

determine a third parameter and a fourth parameter of the projection area and first attribute information of one or more display objects, according to the first parameter and the second parameter;

judge whether the first attribute information of the one or more display objects satisfies a predetermined first presentation requirement, so as to generate a first judgment result; and adjust the first attribute information of the one or more display objects to second attribute information, if the first judgment result indicates that the first attribute information of the one or more display objects does not satisfy the first presentation requirement, wherein the one or more display objects presented in the projection area include at least two display objects, and wherein the processor is further configured to:

obtain presentation attribute information of every two display objects of the at least two display objects in the projection area, after the first attribute information of the one or more display objects is adjusted by an adjustment unit to the second attribute information;

judge whether the presentation attribute information satisfies a predetermined second presentation requirement, so as to generate a second judgment result; and adjust the presentation attribute information of the every two display objects of the at least two display objects in the projection area, if the second judgment result indicates that the presentation attribute information does not satisfy the second presentation requirement.

5. The electronic device according to claim 4, wherein the electronic device further comprises a display unit;

wherein the display unit is able to display and output second data to be displayed; and wherein the first data to be displayed are identical or are not identical with the second data to be displayed.

6. The electronic device according to claim 4, the electronic device further comprises a detection unit, wherein the detection unit corresponds to a detection area; and is able to detect the first parameter of the detection area with respect to the projection unit under the control of the processor; and wherein the detection area is partly or fully overlapped with the projection area.

* * * * *